United States Patent [19]

Allam

[11] 3,968,583

[45] July 13, 1976

[54] NUMERIC DISPLAY FOR ARABIC SPEAKING PEOPLE

[76] Inventor: George A. Allam, 2734-A N. 50th St., Milwaukee, Wis. 53210

[22] Filed: Mar. 24, 1975

[21] Appl. No.: 561,368

[52] U.S. Cl. ..... 40/125 E; 40/28 C; 340/336

[51] Int. Cl.[2] ..... G09F 9/30

[58] Field of Search ..... 40/28 C, 130 E, 130 K, 40/125 E; 340/336; 283/17; 58/50 R, 4 A; 178/113; 197/1 A, 1 R

[56] References Cited

UNITED STATES PATENTS

| | | | |
|---|---|---|---|
| 1,091,335 | 3/1914 | Herrmann | 40/28 C |
| 3,827,043 | 7/1974 | Maezawa | 58/50 R X |

FOREIGN PATENTS OR APPLICATIONS

| | | | |
|---|---|---|---|
| 1,166,176 | 10/1969 | United Kingdom | 340/336 |

*Primary Examiner*—Louis G. Mancene
*Assistant Examiner*—John F. Pitrelli
*Attorney, Agent, or Firm*—Michael, Best & Friedrich

[57] ABSTRACT

The illustrated cluster of 12 various shaped segments permits use of one or more of the segments to graphically display numerals as written in the Arabic language (as distinct from the "Arabic numerals" used in the Western world). Thus the illustrated cluster can be used in devices such as calculators whereby selective energization of the segments permits the calculator to read out in the numeric system of the Arabic language.

6 Claims, 13 Drawing Figures

NUMERIC DISPLAY FOR ARABIC SPEAKING PEOPLE

BACKGROUND OF THE INVENTION

The Arabic numerals used in the Western or European based countries are not the same numerals used in the Arabic language. The Western world type Arabic numerals can be displayed or formed of an array of eight segments, seven of which can be in the now familiar arrangement of straight lines which appear generally in the form of the numeral 8. These seven lines plus a dot for the decimal permit, by selective use, the display of numerals 0 through 9 as well as the decimal point. The form of the numerals used in Arabic language countries cannot be displayed with the usual calculator-type display. Thus the use of today's calculators requires that the Arab also learn the numeral system used in the Western world. This imposes an undesirable burden on the Arabic user.

SUMMARY OF THE INVENTION

The object of this invention is to provide a compact cluster of segments which can be used either as a numeric stencil or as the basis for illuminated numeric displays on calculators, digital clocks, etc. permitting the Arab user to read the numerals in a form familiar to and understandable by him without having to "translate" into an unfamiliar numeral system. As a stencil format this permits a shipper in the Western world to stencil Arabic numerals on shipping cartons by following a simple instruction formula.

The present cluster of uniquely formed and arranged segments is compact enough to permit ready adaptation to stencils, calculator displays, illuminated digital clocks, etc.

DESCRIPTION OF THE DRAWINGS

In FIGS. 3 through 13 the dark portion illustrates that portion which is utilized in making the proper display of the particular numeral. If the cluster is used as a stencil, the dark portions are the portions which would be inked to form the particular numeral. If used in conjunction with an illuminated display, the dark portions would be those portions illuminated.

DESCRIPTION OF THE PREFERRED EMBODIMENT

Figure 1:
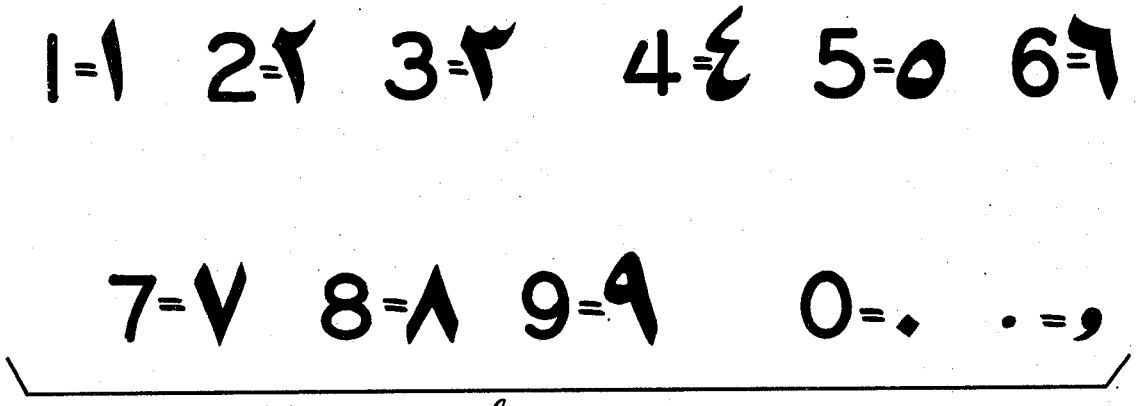
FIG. 1 shows familiar "Western Arabic" numerals with the true Arabic numeral equivalent located to the right of the equal sign.

Referring first to FIG. 1, it will be seen that the Western world numerals 1 through 9, 0 and the decimal point take a quite different form in the true Arabic numeral system. The true Arabic numerals are not compatible with display by means of the usual 8-segment display as used in calculators and the like. The purpose in illustrating these numerals is to both set the frame of the problem as well as permit the reader to compare the displays illustrated in FIGS. 3 through 13 and make a visual comparison with the displayed form and the true form. This permits a rapid evaluation of the high degree of similarity between the display and the true form and thus the high degree of recognition that can be obtained through use of the present cluster of segments.

Figure 2:
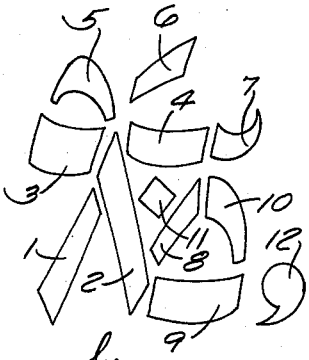
FIG. 2 is an illustration of the present cluster of 12 segments which permits, by selective use of the segments, a display of the true Arabic numerals 0 through 9 as well as the Arabic decimal.

Turning now to FIG. 2, the 12 segments are arranged in the following manner. The first and second segments 1 and 2 are generally rhomboidal in shape and are in the form of an inverted V with the second segment 2 being on the right of and longer than the first segment. Segments 3 and 4 are generally rectangular and are disposed generally horizontally on the left and right, respectively, of the apex of the inverted V formed by segments 1 and 2. At the top of the apex of segments 1 and 2 there is located a segment 5 which is generally crescent shaped and arcs upwardly and then downwardly above segment 3. Segment 6 is generally rhomboidal in shape and originates near the apex of segments 1 and 2 and extends upwardly and to the right of the apex. Segment 7 is generally in the form of a semi-crescent and is disposed generally horizontally of the right end of the fourth segment with the flat (radial) end of the seventh segment facing the end of the fourth segment. Segment 8 is generally rhomboidal in shape and is disposed between the lower end of segment 2 and the right end of segment 4 and projects upwardly and to the right from the lower end of segment 2. Segment 9 is generally rectangular in shape and is disposed horizontally to the right of the lower end of segment 2. Segment 10 is in the form of a half-crescent positioned between the upper end of segment 8 and the right end of segment 9 with the pseudo centers of the curved sides of segment 10 lying generally between segments 8, 9, and 10. Segment 11 is substantially square with the diagonals disposed vertically and horizontally and located in the space between segments 2, 4, and 8. Segment 12 is generally in the form of the Western comma and lies to the right of segment 9 and to the right of the generally rectangular space occupied by segments 1–11.

The use of the segments either as a stencil or as illuminated displays in conjunction with calculators, digital clocks and the like is illustrated in FIGS. 3 through 13. In each of these figures the segment utilized to indicate the particular true Arabic numeral is shown darkened. In the case of a stencil this would be the portion inked in. In the case of an illuminated display this would be the portion illuminated.

Figure 3:
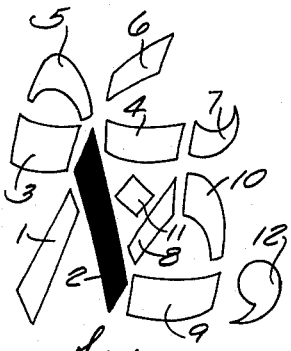
FIGS. 3 through 11 illustrate the manner of displaying the true Arabic numerals 1 through 9.
Figure 4:
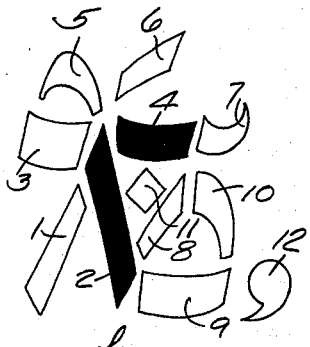
Figure 5:
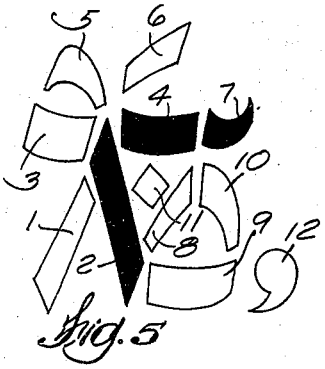
Figure 6:
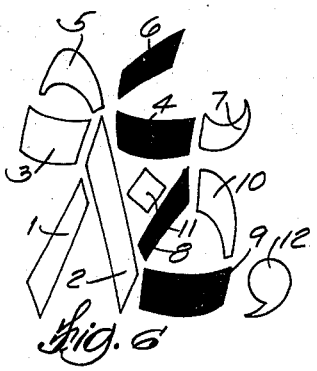
Figure 7:
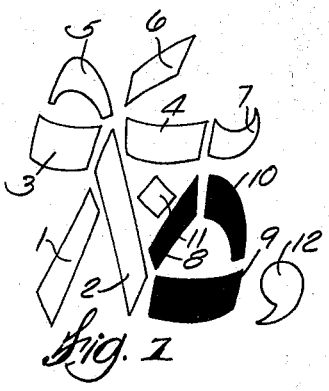
Figure 8:
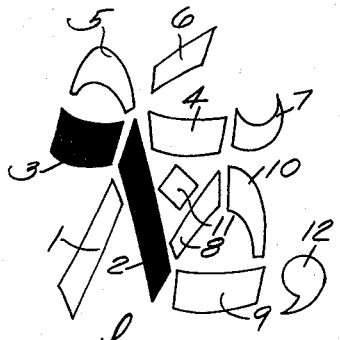
Figure 9:
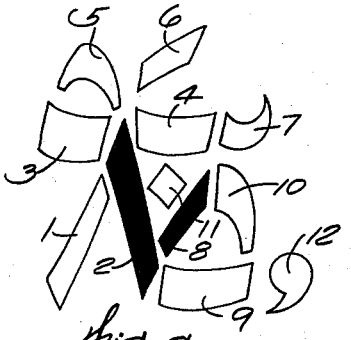
Figure 10:
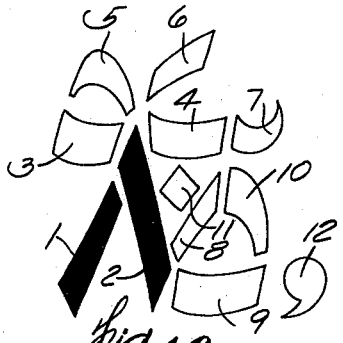
Figure 11:
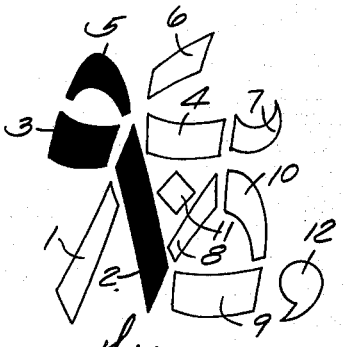
Figure 12:
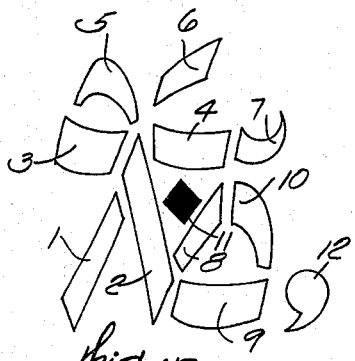
FIG. 12 illustrates the true Arabic numeral 0 display.
Figure 13:
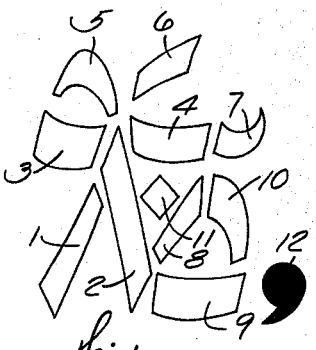
FIG. 13 illustrates the display of the Arabic form of the decimal.

FIG. 3 shows segment 2 employed to illustrate numeral 1. FIG. 4 uses segments 2 and 4 to illustrate the numeral 2. Note the similarity between this and the Arabic numeral 2 illustrated in FIG. 1. In FIG. 5 segments 2, 4, and 7 depict the true Arabic numeral 3 and the display would be readily recognizable to the Arabic user. In FIG. 6 segments 6, 4, 8, and 9 are employed to illustrate numeral 4 and, again, the similarity is quite sufficient for the Arabic user to find it fully recognizable. In FIG. 7 segments 8, 9, and 10 form a good Arabic 5. FIG. 8 uses segments 2 and 3 to illustrate the Arabic 6 in highly recognizable configuration. FIG. 9 illustrates the use of segments 2 and 8 in forming the true Arabic 7 in recognizable, usable form. FIG. 10 uses segments 1 and 2 in forming Arabic 8 while FIG. 11 uses segments 2, 3, and 5 in forming Arabic 9. FIG. 12 shows the Arabic 0 formed with the square segment 11 and in FIG. 13 a comma-like segment 12 is utilized to form the Arabic decimal point.

The degree of similarity of the various combinations described to the true Arabic numerals is highly recognizable to an Arabic user and now permits the adaptation of present day calculator technology to the tremendous market represented by this large population group. It simplifies life for shippers in the Western world in forming recognizable numerals on shipping cartons and the like by use of this cluster as a stencil. The method of selectively energizing the various segments in illuminated displays on calculators, clocks and the like is a simple matter for those in the art and need not be illustrated here. The novel concept here is the arrangement of the various segments so as to permit a legible and recognizable readout system for Arabic users and which arrangement utilizes a minimum number of segments in forming the desired numerals.

The Arabic decimal, segment 12, is logically placed as shown but could conceivably be placed elsewhere. The Arabic numeral 0, segment 11, could be placed in the space between segments 1 and 3, or between segments 6 and 7 but the illustrated location keeps the numeral spaced better. Segment 1 is used only in forming Arabic 8 (FIG. 10) and the Arabic 8 could possibly be formed by segments 8 and 10 but the size and shape suffer.

I claim:

1. A display device comprising a cluster of segments which segments may be utilized alone or in combination with others to graphically display numerals as written in the Arabic language, the segments being arranged as follows;

1st and 2nd rhomboidal segments arranged generally in the form of an inverted V with said 2nd segment being on the right of and longer than said 1st segment;

3rd and 4th generally rectangular segments disposed generally horizontally at the apex of said inverted V and, respectively, on the left and right of said apex;

a 5th segment generally in the form of a crescent originating at said apex and arcing upwardly and then downwardly above said 3rd segment;

a 6th segment generally rhomboidal in shape and originating generally at said apex and extending upwardly to the right of the apex;

a 7th segment generally in the form of a semi-crescent disposed generally horizontally with the flat end of the segment facing said 4th segment;

an 8th segment generally of rhomboidal shape disposed between the lower end of the 2nd segment and the right end of the 4th segment;

a 9th segment generally rectangular in shape disposed horizontally to the right of the lower end of said 2nd segment;

a 10th segment generally in the form of a semi-crescent positioned between the upper end of said 8th segment and the right end of said 9th segment with the pseudo centers of the 10th segment lying generally between the 8th, 9th, and 10th segments;

an 11th segment generally square in configuration;

whereby the Arabic numeric sequence is formed by use or display of the segments according to the following schedule:

| Numeral | Segments Used |
|---|---|
| 1 | 2 |
| 2 | 2 and 4 |
| 3 | 2, 4, 7 |
| 4 | 6, 4, 8, 9 |
| 5 | 8, 9, 10 |
| 6 | 2, 3 |
| 7 | 2, 8 |
| 8 | 1, 2 |
| 9 | 2, 3, 5 |
| 0 | 11 |

2. The device according to claim 1 in which the diagonals of the 11th segment are disposed vertically and horizontally and the segment is located in the space between the 2nd, 4th, and 8th segments.

3. The device according to claim 1 in which the 4th segment extends further to the right than the lower end of the 2nd segment whereby the 8th segment is inclined upwardly and to the right.

4. The device according to claim 1 including a 12th segment having a comma-like shape.

5. The device according to claim 4 in which segments 1–11 lie in a generally rectangular space and the 12th segment is located to one side of said space.

6. The device according to claim 5 in which the 12th segment is located to the right of said space and to the right of the 9th segment.

* * * * *